US007374143B1

(12) United States Patent
Wittke

(10) Patent No.: US 7,374,143 B1
(45) Date of Patent: May 20, 2008

(54) ALL WEATHER CLIPBOARD COVER

(76) Inventor: Victor Wittke, 1987 Lake St., Salt Lake City, UT (US) 84105

( * ) Notice: Subject to any disclaimer, the term of this patent is extended or adjusted under 35 U.S.C. 154(b) by 442 days.

(21) Appl. No.: 11/132,944

(22) Filed: May 20, 2005

(51) Int. Cl.
*B42D 3/00* (2006.01)

(52) U.S. Cl. ..... 248/444.1; 248/451; 281/45

(58) Field of Classification Search ..... 248/441.1; 281/45, 42, 28, 51
See application file for complete search history.

(56) References Cited

U.S. PATENT DOCUMENTS 1,133,979 A * 3/1915 Lee ..... 312/190
1,967,632 A * 7/1934 Simonson ..... 281/45
2,547,167 A * 4/1951 Nielsen ..... 312/190
4,445,728 A 5/1984 Bratton
4,997,088 A * 3/1991 Spry ..... 206/449
5,474,333 A 12/1995 Schrader
5,590,910 A 1/1997 Meth

* cited by examiner

*Primary Examiner*—Korie H. Chan
*Assistant Examiner*—Steven Marsh
(74) *Attorney, Agent, or Firm*—Crossley Patent Law; Mark A. Crossley

(57) ABSTRACT

A removable cover for use with a clipboard, the cover comprising a transparent dome, the dome having two ends and two sides, each side of the dome meeting opposite sides of the clipboard, a closure at the spring-biased end of the clipboard, an aperture in the closure, a coverlet affixed to the aperture, the coverlet covering the spring-biased clip, an opening in a bottom of the coverlet, battery powered LED's illuminating the clipboard via low light sensors, a track around the sides and closure end of the cover providing slideably removable attachment to the clipboard.

13 Claims, 3 Drawing Sheets

ALL WEATHER CLIPBOARD COVER

BACKGROUND OF THE INVENTION

A clipboard is typically comprised of a planar surface of plastic, wood, or similarly rigid materials to which a spring-biased clip is attached to one end. Papers, documents and other materials are held to the clipboard by the clip. Clipboards are used both professionally and recreationally in a wide variety of pursuits. Inclement weather, though, can prohibit the use of clipboards due to wind, wet conditions, or low light conditions or a combination thereof. An ideal solution is a cover which removably attaches to a typical clipboard and provides for relief of these problems such that the clipboard can be used in virtually any situation.

FIELD OF THE INVENTION

The invention relates to clipboards and their uses, and more specifically to an all weather clipboard cover that is illuminated.

SUMMARY OF THE INVENTION

The general purpose of the all weather clipboard cover, described subsequently in greater detail, is to provide a all weather clipboard cover which has many novel features that result in an improved all weather clipboard cover which is not anticipated, rendered obvious, suggested, or even implied by prior art, either alone or in combination thereof.

To accomplish this, the all weather clipboard cover removably covers a clipboard. The typical clipboard has a spring-biased clip at one end. The cover comprises a transparent dome. The dome has two ends and two sides. The dome forms an arc over the clipboard. Each side of the dome extends to meet opposite sides of the clipboard. A closure is at the spring-biased end of the clipboard. The closure substantially encloses that end of the dome. The opposite end of the dome is open. The open end of the dome provides for insertion of a user's hand in accessing items upon the clipboard or writing upon clipboard items. A track provides for removably attaching the cover to the clipboard. The track extends along one side of the dome, across the bottom of the closure, and along the opposite side of the dome. The track comprises a first horizontal. The first horizontal extends outwardly from the sides of the dome. The first horizontal continues along the bottom of the closure. The second horizontal is spaced apart from the first horizontal. The second horizontal is identical to the first horizontal. A vertical border outwardly connects the first horizontal to the second horizontal. The track thereby removably surrounds substantially three edges of a clipboard. The track provides slideable attachment of the invention to the clipboard. The track at the open end of the cover is engaged with the side edges of the clipboard at the spring-biased end of the clipboard. The cover is then slid onto the clipboard until the track at the closure end is engaged with the top edge at the spring-biased end of the clipboard. An aperture in the closure provides for operation of the spring-biased clip. The track is absent along the aperture. A coverlet is affixed to the aperture. The coverlet is flexible waterproof cloth in one example of the invention. In yet another example of the invention, the coverlet is rigid a identical to the dome. Examples of the invention offer coverlet made from a variety of applicable materials. The coverlet shields the clip and spring-biased end of the clipboard. An opening in a bottom of the coverlet provides for access to the spring-biased clip.

Illumination is disposed on the dome interior. The illumination is disposed toward the sides of the dome. The illumination thereby lights the clipboard without interfering in viewing of the clipboard. The invention is offered in examples in which the illumination is engaged by more than one method. The most complete example of the invention provides for automatic switch on of the illumination in low light conditions. The automatic switching mechanism is well known in the art of lighting. The clipboard cover is offered in examples of more than one length, whereby various clipboard sizes are accommodated.

The illumination comprises a parallelepiped body. The body is affixed by adhesive to the interior of the dome. A pair of spaced apart light emitting diodes known as LED's in the art is disposed within the body. The LED's are proximal to outer boundaries of the body. A battery is disposed centrally within the body. The Electrical connects join each LED to the battery. A battery cap threadably and removably contains the battery within the body. The slot in the cap aids in cap removal upon battery replacement.

Thus has been broadly outlined the more important features of the all weather clipboard cover so that the detailed description thereof that follows may be better understood and in order that the present contribution to the art may be better appreciated.

Numerous objects, features and advantages of the all weather clipboard cover will be readily apparent to those of ordinary skill in the art upon reading the following detailed description of presently preferred, but nonetheless illustrative, examples of the all weather clipboard cover when taken in conjunction with the accompanying drawings. In this respect, before explaining the current examples of the all weather clipboard cover in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the all weather clipboard cover. It is therefore important that the claims be regarded as including such equivalent constructions insofar as they do not depart from the spirit and scope of the present invention.

Objects of the all weather clipboard cover, along with various novel features that characterize the invention are particularly pointed out in the claims forming a part of this disclosure. For better understanding of the all weather clipboard cover, its operating advantages and specific objects attained by its uses, refer to the accompanying drawings and description.

DETAILED DESCRIPTION OF THE DRAWINGS

With reference now to the drawings, and in particular FIGS. 1 through 4 thereof, example of the all weather clipboard cover employing the principles and concepts of the present invention and generally designated by the reference number 10 will be described.

Figure 1:
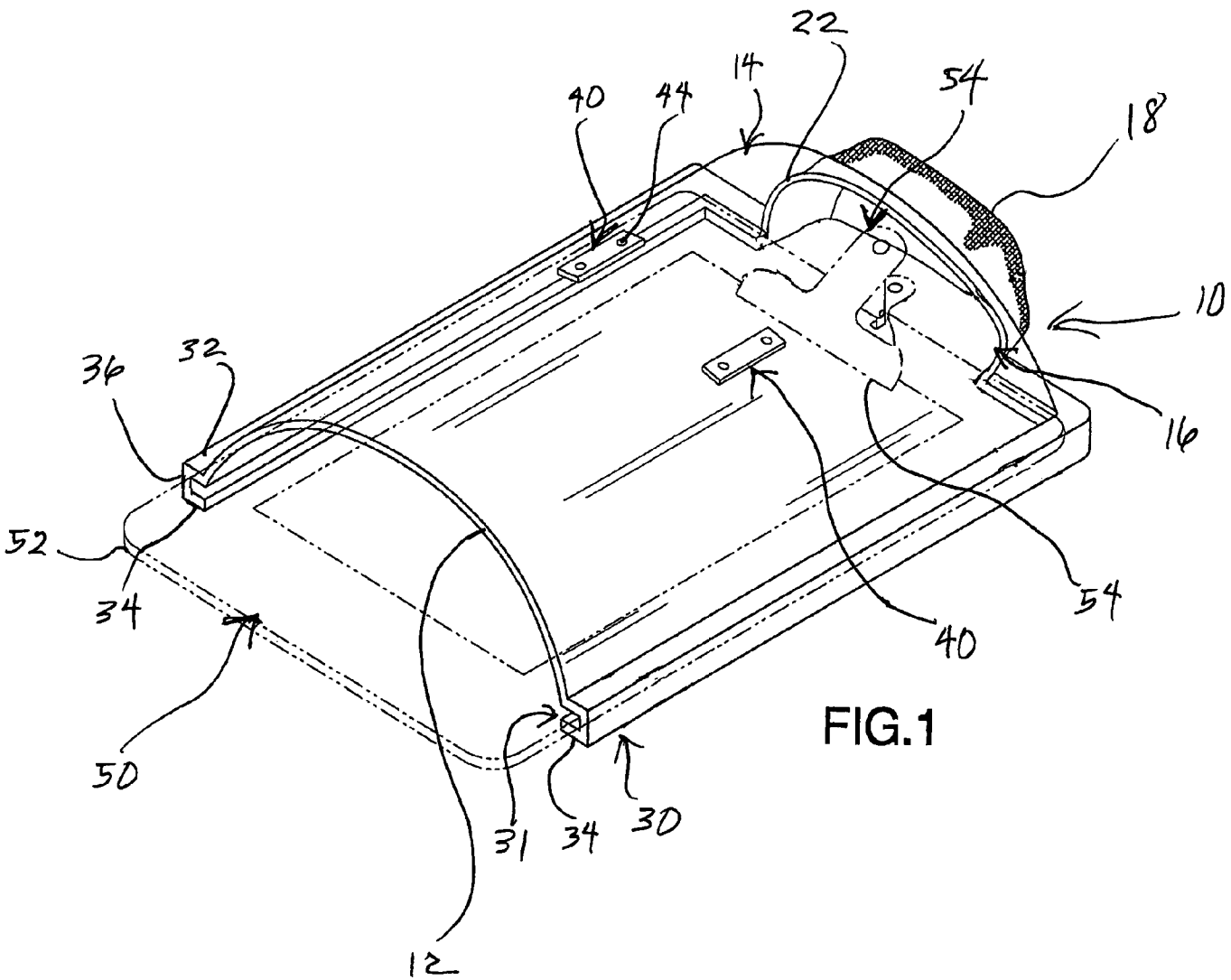
FIG. 1 is a perspective view of the invention installed on a clipboard.
Figure 2:
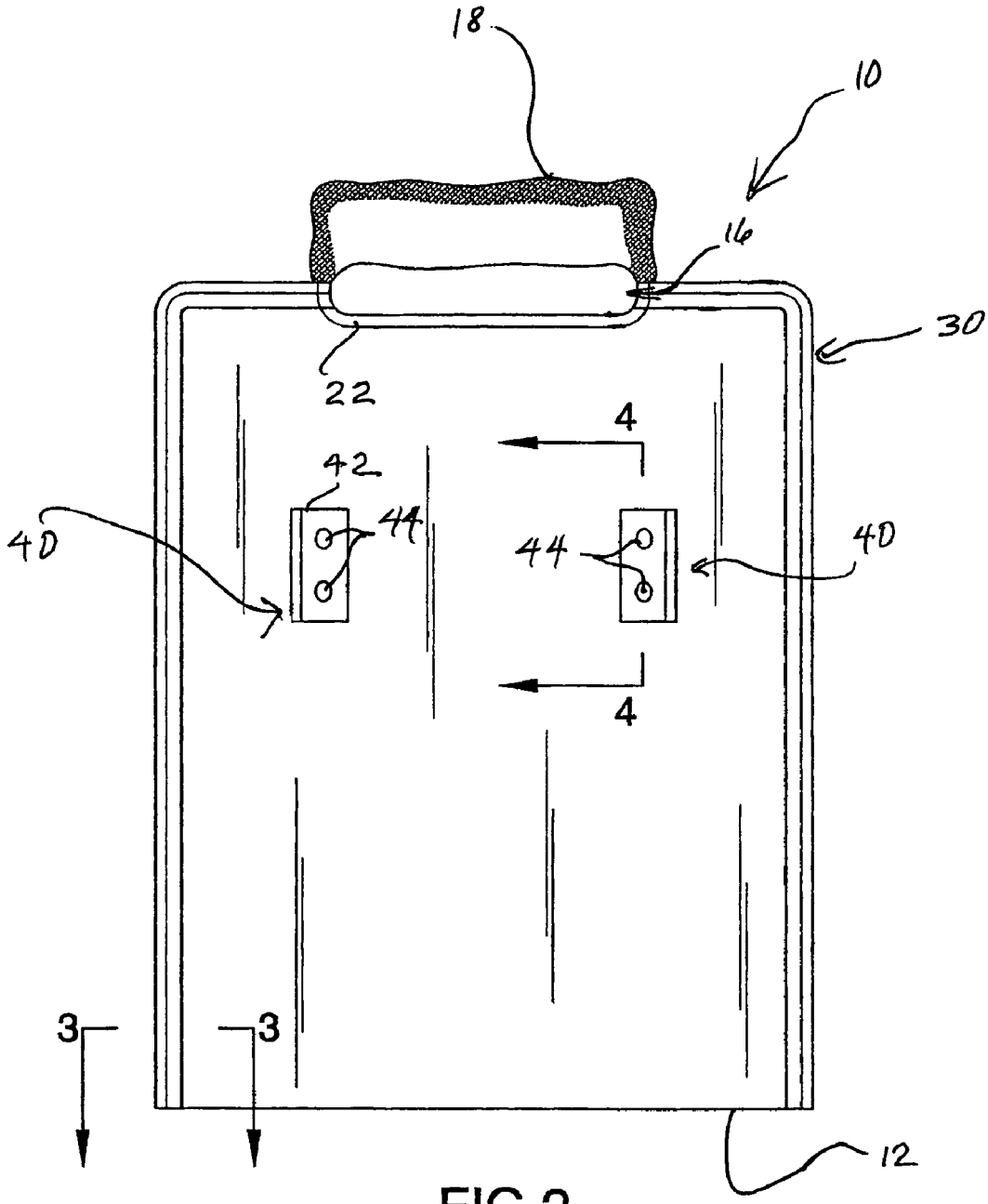
FIG. 2 is a top plan view of the invention.

Referring to FIGS. 1 and 2, the invention 10 removably covers the clipboard 50. The clipboard 50 has a spring-biased clip 54 at one end thereof. The cover 10 comprises a transparent dome 12. The dome 12 has two ends and two sides. The dome 12 forms an arc over the clipboard 50. Each side of the dome 12 extends to meet opposite sides of the clipboard 50. The closure 14 is at the spring-biased end of the clipboard 50. The closure 14 substantially encloses the spring-based end of the dome 12. The opposite end of the dome 12 is open. The open end of the dome 12 provides for insertion of a user's hand (not shown) in accessing items upon or writing upon the items (not shown). The invention 10 is removably affixed to the clipboard 50 via the attachment 30. The attachment 30 comprises the track 31. The track 31 extends along one side of the dome 12, across part of the bottom of the closure 14, and along the opposite side of the dome 12. The track 31 comprises a first horizontal 32. The first horizontal 32 extends outwardly from the sides of the dome 12. The first horizontal 32 continues along the bottom of the closure 14. The second horizontal 34 is spaced apart from the first horizontal 32. The second horizontal 34 is identical to the first horizontal 32. The vertical border 36 outwardly connects the first horizontal 32 to the second horizontal 34.

The track 31 thereby removably surrounds substantially three edges 52 of the clipboard 50. The track 31 provides slideable attachment 30 of the invention 10 to the clipboard 50. The aperture 16 in the closure 14 provides for operation of the spring-biased clip 54. The track 31 is absent along aperture 16. The coverlet 18 is affixed to the closure 14 via the bond 22. The coverlet 18 is flexible. The coverlet 18 is over the spring-biased clip 54. The opening of the coverlet 18 and the opening in the closure 14 combine to form the aperture 16. The aperture 16 provides for access to the spring-biased clip 54. Illumination 40 is disposed on the dome interior 13 (FIG. 3) of the dome. The illumination 40 is disposed toward the sides of the dome 12 such that the illumination 40 is less likely to visually interfere with items on the clipboard 50. The illumination 40 thereby lights the clipboard 50 without interfering in viewing of the clipboard 50.

Figure 3:
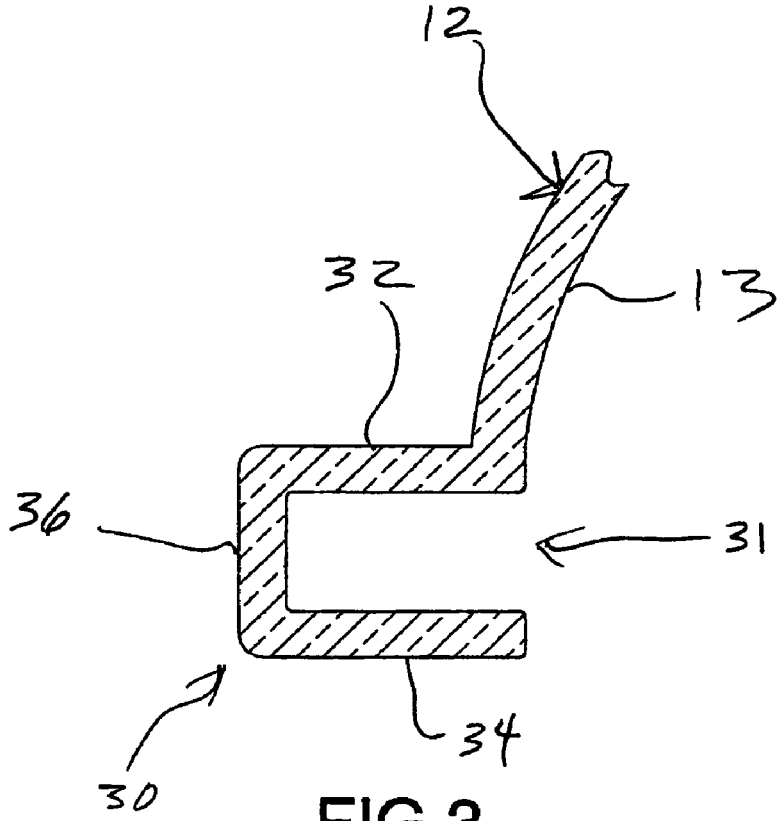
FIG. 3 is an end view of the track of FIG. 2 taken along the line 3-3.

Referring to FIG. 3, the attachment 30 is further illustrated. Track 31 is prepared to receive edges of the clipboard 50.

Figure 4:
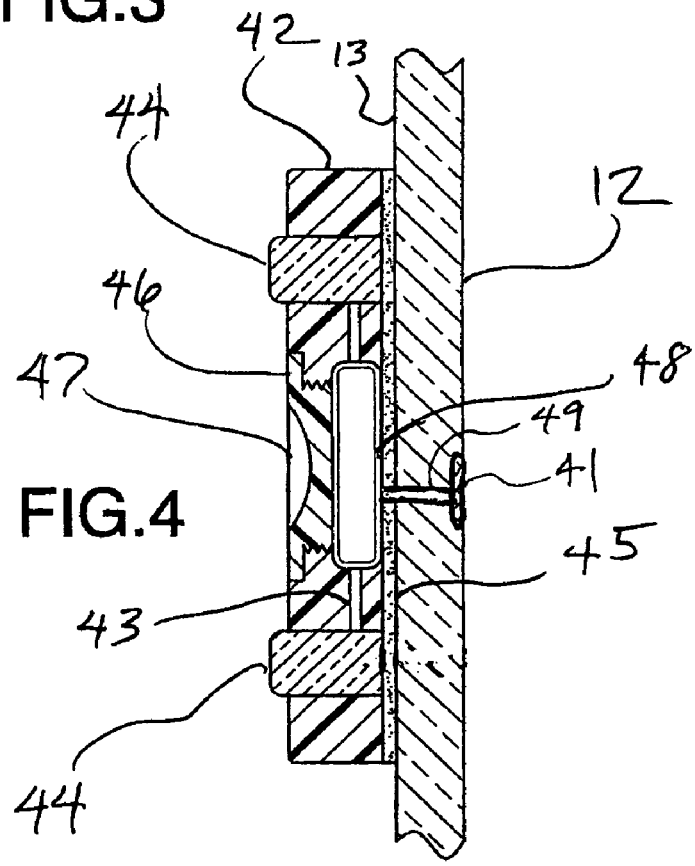
FIG. 4 is a cross sectional view of the illumination of the invention in FIG. 2, taken along the line 4-4.

Referring to FIG. 4, the illumination comprises a parallelepiped body 42. The body 42 is affixed by adhesive 45 to the interior 13 of the dome 12. The pair of spaced apart LED's 44 is disposed within the body 42. The LED's 44 are proximal to outer boundaries of the body 42. The battery 48 is disposed centrally within the body 42. The connect 43 connects each LED 44 to the battery 48. The battery cap 46 threadably and removably contains the battery 48 within the body 42. The slot 47 in the cap 46 aids in cap 46 removal upon battery 48 replacement. The sensor 41 detects low light conditions within the dome 12 and switches on the LED's 44. The connection 49 connects the sensor 41 to the battery 48.

With respect to the above description then, it is to be realized that the optimum dimensional relationships for the parts of the all weather clipboard cover, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A removable cover for use with a clipboard having a planar base which provides a writing surface and which has a spring-biased clip at one end thereof, the cover comprising:

a transparent arch extending from vertical sides, the arch having two ends and two sides, the arch forming an arc, each side of the arch meeting opposite sides of the clipboard, the arch thereby covering the clipboard;

a closure at one end of the arch, the closure at the spring-biased end of the clipboard;

an attachment, the attachment removably affixing the cover to the clipboard, the attachment comprising a track extending along one side of the arch, across a bottom of the closure, and along the opposite side of the arch, the track comprising:

a first horizontal member, the first horizontal member extending outwardly from the sides of the arch, the first horizontal member continuing along the bottom of the closure;

a second horizontal member spaced apart from the first horizontal member, the second horizontal member identical to the first horizontal member;

a vertical border outwardly connecting the horizontals members, whereby the track removably surrounds substantially three edges of the clipboard, thereby providing slideable attachment to the clipboard;

an aperture in the closure, the aperture providing for operation of the spring-biased clip, the track absent along the aperture;

a coverlet affixed around the aperture, the coverlet over the spring-biased clip;

an opening in a bottom of the coverlet, the opening adjoining the aperture, the opening providing for access to the spring-biased clip.

2. The removable cover in claim 1 wherein the coverlet is flexible.

3. The removable cover in claim 1 wherein the coverlet is rigid.

4. The removable cover in claim 2 wherein the cover is further comprised of illumination means for illuminating the clipboard;

switching means for the illumination means.

5. The removable cover in claim 3 wherein the cover is further comprised of illumination means for illuminating the clipboard;

switching means for the illumination means.

6. The removable cover in claim 4 wherein the switching means is triggered by low light conditions.

7. The removable cover in claim 5 wherein the switching means is triggered by low light conditions.

8. A removable cover for use with a clipboard having a planar base which provides a writing surface and which has a spring-biased clip at one end thereof, the cover comprising:

a transparent arch, the arch having two ends and two sides, the arch forming an arc, each side of the arch meeting opposite sides of the clipboard, the arch thereby covering the clipboard;

a closure at one end of the arch, the closure at the spring-biased end of the clipboard;

an attachment, the attachment removably affixing the cover to the clipboard, the attachment comprising a track extending along one side of the arch, across a bottom of the closure, and along the opposite side of the arch, the track comprising:

a first horizontal member, the first horizontal member extending outwardly from the sides of the arch, the horizontal member continuing along the bottom of the closure;

a second horizontal member spaced apart from the first horizontal member, the second horizontal member identical to the first horizontal member;

a vertical border outwardly connecting the horizontals members, whereby the track removably surrounds substantially three edges of the clipboard, thereby providing slideable attachment to the clipboard;

an aperture in the closure, the aperture providing for operation of the spring-biased clip, the track absent along aperture;

a coverlet affixed around the aperture, the coverlet over the spring-biased clip;

an opening in a bottom of the coverlet, the opening adjoining the aperture, the opening providing for access to the spring-biased clip;

illumination, the illumination comprising:

a parallelepiped body affixed to an interior of the arch;

a pair of spaced apart LED's disposed within the body, the LED's proximal to outer boundaries of the body;

a battery disposed centrally within the body;

connects, whereby the battery is connected to the LED's;

a battery cap removably containing the battery within the body.

9. The removable cover in claim 8 wherein the coverlet is flexible.

10. The removable cover in claim 8 wherein the coverlet is rigid.

11. The removable cover in claim 8 wherein the illumination is switched on by a sensor, the sensor triggered by low light conditions.

12. The removable cover in claim 9 wherein the illumination is switched on by a sensor, the sensor triggered by low light conditions.

13. The removable cover in claim 10 wherein the illumination is switched on by a sensor, the sensor triggered by low light conditions.

* * * * *